United States Patent [19]

Morris

[11] 4,353,473

[45] Oct. 12, 1982

[54] PUSH BUTTON SAFETY CAP FOR CONTAINERS

[76] Inventor: Glenn H. Morris, 4203 Highwood Dr., Chattanooga, Tenn. 37415

[21] Appl. No.: 268,278

[22] Filed: May 29, 1981

Related U.S. Application Data

[63] Continuation-in-part of Ser. No. 169,840, Jul. 17, 1980, Pat. No. 4,285,437.

[51] Int. Cl.[3] ..... B65D 55/02

[52] U.S. Cl. ..... 215/220; 215/206

[58] Field of Search ..... 215/206, 220, 219

[56] References Cited

U.S. PATENT DOCUMENTS

| | | | |
|---|---|---|---|
| 3,520,435 | 7/1970 | McIntosh | 215/220 |
| 3,710,970 | 1/1973 | Elfline | 215/219 X |
| 3,756,444 | 9/1973 | McIntosh | 215/220 |
| 4,223,794 | 9/1980 | Morris | 215/220 |
| 4,281,771 | 8/1981 | Siegel | 215/220 |
| 4,285,437 | 8/1981 | Morris | 215/220 |

*Primary Examiner*—George T. Hall

*Attorney, Agent, or Firm*—Brady, O'Boyle & Gates

[57] ABSTRACT

A two component rotational safety cap for containers of harmful substances is disclosed. The cap is more positive and more reliable in its operation. It has several false depressed push button positions during unscrewing rotation to confuse children and a single unscrewing depressed location of the push button corresponding with alignment of two visual indicator elements on the cap components to facilitate cap unscrewing by adult users without difficulty or discomfort. The safety cap has only a single positive tightening element on each cap component, one of which elements is a spring ramp element on the inner cap component whose elevation relative to the outer cap component is controlled by fixed ramps on the outer cap component.

14 Claims, 14 Drawing Figures

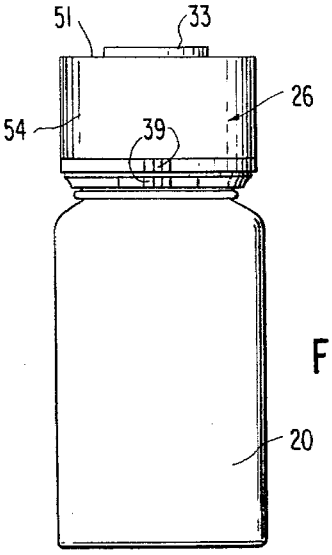
FIG.1
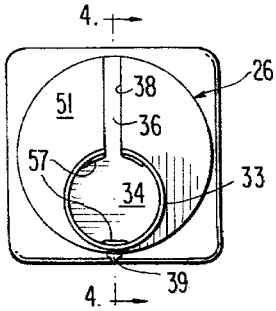
FIG.2
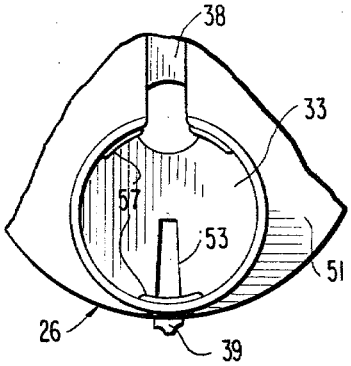
FIG.3
FIG.10
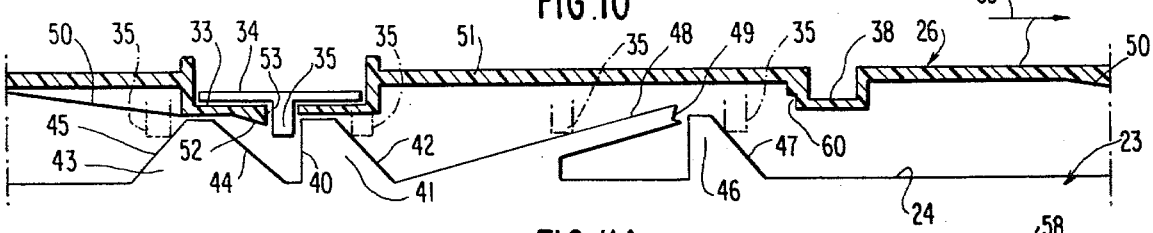
FIG.11A
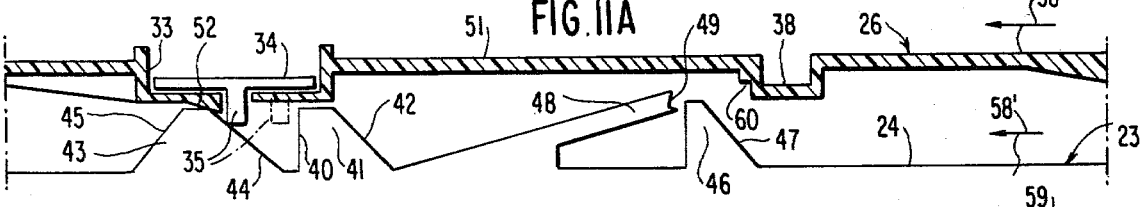
FIG.11B
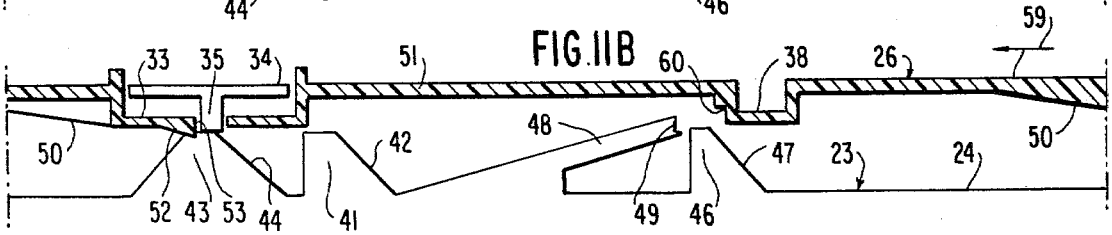
FIG.11C
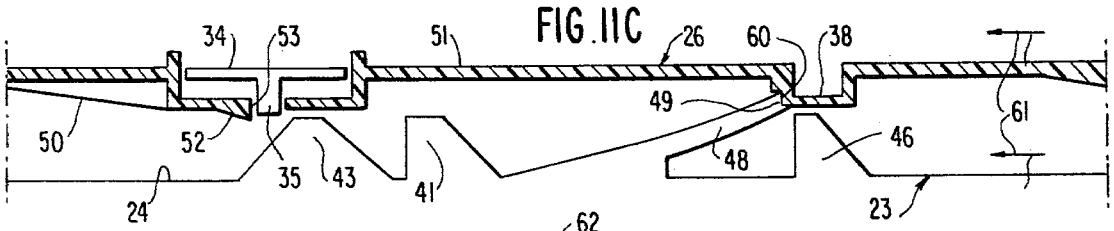
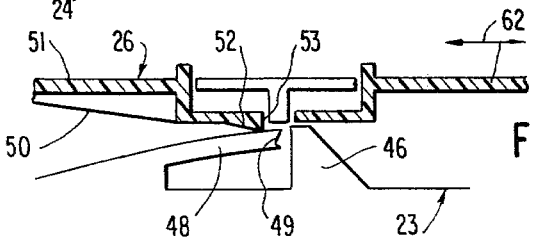
FIG.12

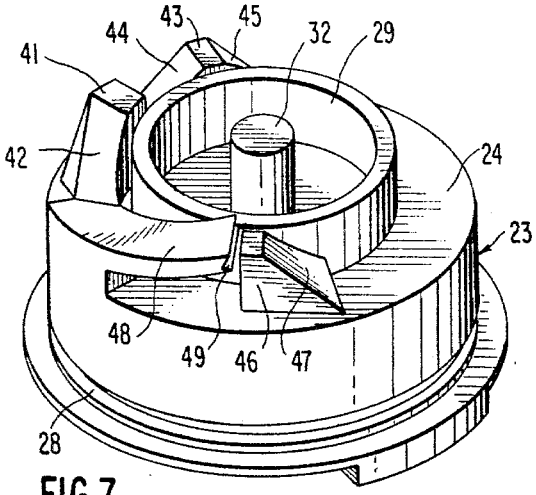
FIG.7
FIG.4
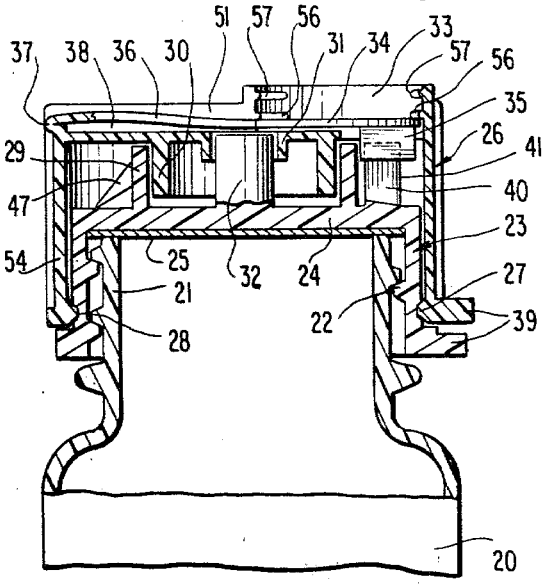
FIG.8
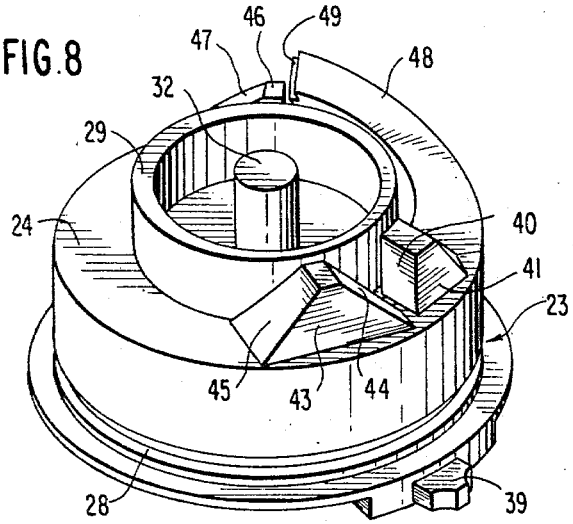
FIG.5
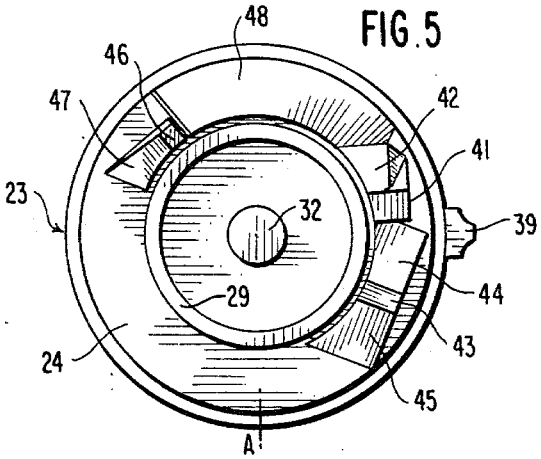
FIG.9
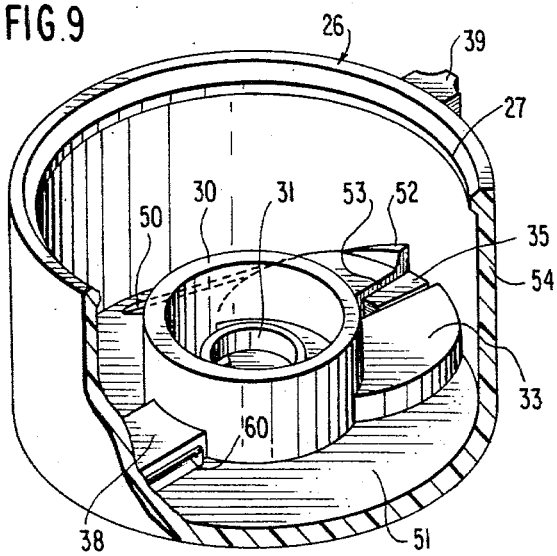
FIG.6
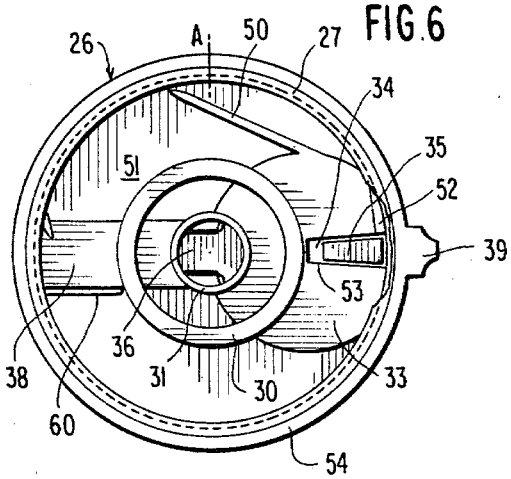

PUSH BUTTON SAFETY CAP FOR CONTAINERS

CROSS-REFERENCE TO RELATED APPLICATION

This application is a continuation-in-part of prior application Ser. No. 06/169,840, filed July 17, 1980, for PUSH BUTTON CHILD-RESISTANT CAP FOR CONTAINERS; now U.S. Pat. No. 4,285,437.

BACKGROUND OF THE INVENTION

This invention in general has the same objectives and advantages described in U.S. Pat. No. 4,223,794 and in the above-referenced copending application.

Additionally, the present invention seeks to provide a safety or child-proof closure cap which is even more confusing to children seeking to open it and which has a more positive, reliable and less confusing mode of operation when used by adults.

In accomplishing these aims, a two component rotational safety cap for containers of harmful substances is provided which during the opening or unscrewing mode has several false depressed push button positions which cannot produce release of the closure cap, thus further confusing children, and a single true depressed push button position which produces cap release in an easy and comfortable manner by an adult.

Additionally, the present invention provides a safety cap which possesses only a single positive and reliable engaging tightening element on each rotational cap component, one of which elements is a spring ramp element on the inner cap component which has interlocking relationship in a secure manner with a fixed abutment element on the outer cap component to enable secure tightening of the safety cap. The spring ramp serves the dual purpose of engaging a lug or tooth on the bottom of the push button to elevate the push button to indicate that the closure cap is in a safe or child-resistant condition. Positive camming means is provided on the outer cap component to contact and depress the spring ramp element to an elevation whereby the spring ramp element will not interfere with desirable rotation of the outer cap component in either direction.

Other benefits and advantages of the invention will appear to those skilled in the art during the course of the following detailed description.

BRIEF DESCRIPTION OF THE DRAWINGS

FIG. 1 is a side elevation of a safety cap according to the present invention applied to a typical container.

FIG. 2 is a plan view of the invention as depicted in FIG. 1.

FIG. 3 is an enlarged fragmentary plan view of an outer cap component with the push button omitted.

FIG. 4 is an enlarged central vertical section taken on line 4—4 of FIG. 2.

FIG. 5 is a plan view of the inner cap component.

FIG. 6 is a bottom plan view of the outer cap component.

FIG. 7 is a perspective view of the inner cap component.

FIG. 8 is a further perspective view of the inner cap component in a rotated position.

FIG. 9 is a perspective view of the outer cap component, partly broken away and partly in cross section.

FIG. 10 is a developed or rolled out view of the two cap components depicting the unscrewing mode, and in phantom lines showing the false depressed push button positions to confuse children taken on line A in FIGS. 5 and 6.

FIGS. 11A through 11C are similar developed views of the two cap components showing progressive stages of cap tightening.

FIG. 12 is a similar fragmentary view showing the depression of a spring ramp element on the inner cap component by camming means on the outer component.

DETAILED DESCRIPTION

Referring to the drawings in detail wherein like numerals designate like parts, a container 20 such as a typical glass or plastics medicine container includes a threaded neck 21 which is engaged by the internal screw-threads 22 of an interior generally cylindrical safety cap component 23 including a top wall 24. A suitable seal 25 is interposed between the wall 24 and the end face of container neck 21, as shown.

An outer safety cap component 26 of cylindrical form engages telescopically over the inner cap component 23, as best shown in FIG. 4, and a rotational connection between the two cap components is maintained through the interfitting of an internal annular bead 27 on the component 26 with a mating annular groove 28 of the component 23. This detent arrangement maintains the two cap components permanently assembled through snap action while allowing free relative rotation between them, except as constrained by elements of the invention, to be described. The outer component 26 contains no screw-threads. It is preferably knurled or ribbed on the exterior of its side wall.

To provide maximum lateral stability between the two components to prevent binding and promote ease of operation, a ring extension 29 on the top wall 24 of inner cap component 23 receives, in close fitting relationship, a smaller depending ring extension 30 of the outer component 26. Additionally, the latter may also have a smaller concentric ring 31 engaging over a center axial post 32 rising from the interior cap component.

The outer component 26 has a top wall well 33 for a push button tab 34 having an integral lower side depending radial lug or tooth 35 which extends from the periphery of the tab 34 inwardly to a point near the center of the push button tab. The tab 34 is preferably connected to the cap component 26 through a radial thin strip 36 which is hinged at 37, FIG. 4, to the side wall of the outer cap component. The component 26 has a top wall groove 38 to receive the attaching strip 36, as best shown in FIG. 4. The strip 36 and groove 38 could be omitted, if desired.

Each cap component 23 and 26 has a radially projecting visual indicator element 39 at the bottom of its side wall to enable an adult user of the container to know at a glance that the safety closure cap is in a releasable condition, as will be further explained. The two indicator elements 39 are in superposed alignment at this time. A blind user of the container can detect by feel when the elements 39 are in alignment to permit unscrewing of the closure cap.

The heart of the invention, now to be described, comprises on the inner cap component 23 a vertical unscrewing abutment surface 40 on one side of a fixed lug 41 attached to top wall 24 and having on its other side an inclined ramp surface 42 adapted to be cammingly engaged by the depending lug 35 of push button tab 34. Another fixed lug 43 rises from the top wall 24 to the same height as the lug 41 and has opposite side ramp faces 44 and 45 which can engage and elevate the push button lug 35 at certain times. An additional stationary upstanding lug 46 on the top wall 24 having the same height as the lugs 41 and 43 includes one inclined ramp surface 47 spaced approximately 180 degrees from the ramp surface 45.

Between the circumferentially spaced lugs 41 and 46, an arcuate cantilevered spring ramp element 48 rises from the top wall 24. The bottom of the spring ramp element is adjacent to the fixed lug 41 while its top is near the lug 46 and slightly above this lug, FIG. 10, when the element 48 is in a relaxed state. The free end of spring ramp element 48 has a right angular locking notch 49 formed therein, for a purpose to be fully described.

It is to be noted that the several fixed lugs 41, 43 and 46 of cap component 23 lie on a common circumference of one radius. The spring ramp element 48, while lying on the same circumference as the three fixed lugs, is radially wider than the lugs and therefore projects radially beyond the lugs, as best shown in FIG. 5, for a reason to be explained.

Also, as a part of the essence of the invention, the outer component 26 of the safety cap has a gradually inclined narrow ramp 50 descending from its top wall 51 and having its lowest portion adjacent to the bottom face of the well 33, FIGS. 6 and 9. A short extension 52 of this ramp or cam 50 descends from the bottom face of the well 33 to an elevation slightly below the tops of the three fixed lugs 41, 43 and 46 in the assembled relationship of the two cap components, FIGS. 11C and 12. The lowermost end of short ramp 52 terminates at one side of a slot 53 in the bottom wall of well 33, which slot receives the depending lug or tooth 35 of push button tab 34. It should be noted that the ramp extension 52 is closely addacent to the interior of the cylindrical side wall 54 of outer cap component 26 so as to lie in the path of that portion of the leading end of spring ramp 48 which is radially outside of the three stationary lugs 41, 43 and 46, as above-described.

The operation of the push button safety cap can best be described with reference to FIGS. 10, 11A through 11C and 12. FIG. 10 in full lines depicts the relationship of inner and outer cap components 23 and 26 in the unscrewing or opening of the safety cap. Assuming the cap to be secured on the container 20 in a firm manner and an adult user wishes to open the container, such user can rotate the outer component 26 counterclockwise, FIG. 2, or in the direction of the arrow 55, FIG. 10, until the indicator elements 39 are in alignment one above the other. The user will then know that push button tab 34 can be depressed in the well 33 to the position shown in FIG. 10 where the depending lug 35 is well below the top of fixed lug 41 and in opposed relationship to the unscrewing abutment surface 40. Further turning of outer component 26 in the direction of arrow 55 will bring lug 35 into engagement with abutment surface 40 while the push button tab remains depressed and will cause the unscrewing and release of the inner cap component 23 from the container 20 along with the outer cap component.

It should be noted that, as in the referenced pending application, the push button tab 34 is constrained in its depressed active position, FIG. 4, by lower detent ribs 56 of the well 33 and is constrained in the raised inactive position, FIGS. 11B and 11C, by being between the ribs 56 and coacting upper detent ribs 57. This renders the action of the push button tab 34 more positive and more controllable by the adult user. When depressed, as in FIG. 4, the lug 35 is well below the tops of fixed lugs 41, 43 and 46. When elevated by the camming action of ramp surfaces 42, 45, 47 and 48, the bottom of lug 35 is above and can clear the tops of the fixed lugs on inner component 23, as shown for example in FIG. 11B.

Still referring primarily to FIG. 10, a child attempting to unscrew the safety cap will normally turn the outer component 26 counterclockwise without depressing push button tab 34 and the outer component will spin freely and no release of the cap will be accomplished. If the child happens to depress the push button tab 34, the latter will assume four false depressed positions during rotation of the outer component 26 allowed by the spaces between fixed lugs 41, 43 and 46 and the space between spring ramp 48 and lug 41. The false depressed positions of the push button lug 35 are shown in broken lines in FIG. 10. True active depressed position of lug 35 opposite abutment surface 40 is shown in full lines in FIG. 10. A child will be unlikely to find the active or true depressed position of the push button shown in FIG. 10 because he will not understand the indicating relationship of the elements 39. Thus, the invention in the unscrewing mode of operation offers further confusion for a child seeking to open the safety cap compared to the prior art.

The operation of down screwing and securing the safety cap is depicted in FIGS. 11A through 11C. In FIG. 11A, the user begins turning the outer cap component 26 clockwise, FIG. 2, and in the direction of the arrow 58. Initially, the lug 35 of the push button depressed by the prior unscrewing of the cap will engage ramp surface 44 lightly and the inner component 23 of the cap will start to rotate with the outer component 26 in the same direction as the latter shown by the arrow 58'. Following increased resistance caused by the screw-threads 22 of cap component 23, the depressed lug 35 will ride up on the ramp surface 44 to the elevated position shown in FIG. 11B, and the outer component 26 will continue rotating in the direction of the arrow 59 while the inner component 23 will resist rotation. This is the second stage of the screw-down operation shown in FIG. 11B.

The third and final stage of tightening of the safety cap is shown in FIG. 11C. The outer component 26 has advanced in relation to the inner component 23 in the screwing down process until a square notch 60 formed in one side of the floor defined by groove 38 engages and interlocks with the square locking notch 49 in the leading end of the spring ramp 48. This positive engagement from which the spring ramp element 48 cannot escape causes both cap components 26 and 23 to rotate as a unit, as shown by the arrows 61 until final tightening of the safety cap is accomplished, at which time the outer cap component 26 is free-turning in the unscrewing direction for the safety of children seeking to release the cap.

FIG. 12 depicts the operation of the described camming means 50 and 52 on the outer cap component 26 to assure that the upper extremity of spring ramp element 48 will not impede free rotation of the outer component in either direction indicated by the arrows 62, at times other than during the final cap tightening process shown in FIG. 11C. During such relative rotation in either direction of the outer component 26, the gradual cam 50 depending from the top wall 51 will first act on the spring ramp element 48 to bend and depress it, followed by a similar action of the cam 52 which, in effect, is an extension of the cam 50 to depress the element 48 below the tops of fixed lugs 41, 43 and 46. This assures that the depending drive lug 35 of push button tab 34 will not catch and hang up on the spring ramp element 48, as shown in FIG. 12. In the operation of the safety cap, the only tightening engagement between the two components 26 and 23 in the final tightening stage, FIG. 11C, is the engagement of the two notches 49 and 60 in a secure interlocking manner. This single position positive tightening engagement of the two cap components is a feature of the invention. The camming means 50 and 52 is necessary to preclude any other faulty or undesirable driving engagement through the spring ramp element 48.

It should be noted that the engagement of cams 50 and 52 with element 48 occurs near the periphery of the cap and outside of the circumferential path on which the fixed lugs 41, 43 and 46 are located. This is why the spring ramp element 48 is radially wider and extends radially outside of the lugs 41, 43 and 46 to be engageable by cams 50 and 52, which latter cam is also radially outwardly of the fixed lugs of component 23.

It may now be seen that an efficient and reliable safety cap is provided by the invention which is more confusing to children due to the several false depressed positions of the push button, and less confusing and easier to operate by adults mainly due to a single position positive tightening engagement between the two components shown in FIG. 11C. The device is entirely practical from the standpoint of modern plastics molding techniques.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A safety cap for threaded containers of harmful substances comprising rotationally connected inner and outer cap components, the inner cap component being threaded for engagement with the threads of a container, a push button element on the end wall of the outer cap component having an attached depending drive lug, fixed depending cam means on the end wall of the outer cap component and being in part near the periphery of the outer cap component, a plurality of circumferentially spaced fixed lugs on the opposing end wall of the inner cap component and lying on a common radius inwardly of said cam means of the outer cap component and having inclined ramp surfaces engageable with said drive lug of the push button element to raise the push button element during relative rotation of the two cap components, one of said fixed lugs of the inner cap component having a positive drive surface substantially normal to the end wall of the inner cap component and being engageable by the drive lug of the push button element when the latter is in a depressed driving position to cause release of the safety cap from a container, a spring ramp element rising from the end wall of the inner cap component and lying between a pair of said fixed lugs of the inner cap component and extending radially outwardly of said fixed lugs to lie in the path of movement of said cam means, and a driving element on the outer cap component separate from and spaced circumferentially from the depending drive lug of the push button element and being engageable with the spring ramp element during the screwing down of the safety cap on a container to drive the inner cap component to a fully tightened position.

2. A safety cap for threaded containers as defined in claim 1, and said spring ramp element when in a relaxed state having its free end projecting above the tops of said fixed lugs so as to be in the path of movement of said driving element on the outer cap component, said driving element depending from the end wall of the outer cap component.

3. A safety cap for threaded containers as defined in claim 2, and interfitting lockable recess means on the free end of the spring ramp element and on said driving element to assure positive driving of the inner cap component by the outer cap component during the screwing down of the safety cap.

4. A safety cap for threaded containers as defined in claim 3, and the spring ramp element being arcuate and elongated and following the periphery of the inner cap component and extending around a substantial circumferential portion of the inner cap component less than 180 degrees between one pair of said fixed lugs on the inner cap component.

5. A safety cap for threaded containers as defined in claim 1, and an indicator element on the inner and outer cap components adapted to register during relative rotation of the cap components to indicate to an adult user that the push button element is located in a depressable driving position relative to said positive drive surface to allow unscrewing of the safety cap.

6. A safety cap for threaded containers as defined in claim 5, and spaced detent means for said push button element on the outer cap component to hold the push button element releasably in a depressed active position and in an elevated inactive position relative to said fixed lugs of the inner cap component.

7. A safety cap for threaded containers as defined in claim 1, and one pair of said fixed lugs on the inner cap component being spaced apart circumferentially approximately 180 degrees, one fixed lug of said pair having two convergent inclined ramp surfaces and the other lug of the pair having a single inclined ramp surface, and said other lug of the pair being positioned close to the free end of said spring ramp element.

8. A safety cap for threaded containers as defined in claim 7, and another of said fixed lugs being spaced circumferentially from said one fixed lug of the pair a comparatively short distance and being positioned substantially at the lower end of the spring ramp element, and said another of the fixed lugs having said positive drive surface substantially normal to the end wall of the inner cap component.

9. A safety cap for threaded containers as defined in claim 1, and said fixed depending cam means comprising inclined ramp cam means arranged to gradually depress said spring ramp element below the tops of said fixed lugs during relative rotation of the inner and outer cap components.

10. A safety cap for threaded containers as defined in claim 9, and said inclined ramp cam means consisting of two generally circumferentially spaced fixed inclined ramp sections on the outer cap component, one section being shorter than the other section and constituting substantially a continuation thereof.

11. A safety cap for threaded containers of harmful substances comprising rotationally connected inner and outer cap components, the inner cap component being threaded for engagement with the threads of a container, a push button element on the end wall of the outer cap component having an attached depending drive lug, a plurality of circumferentially spaced fixed lugs on the opposing end wall of the inner cap component and lying on a substantially common radius and having inclined ramp surfaces engageable with said drive lug of the push button element to raise the push button element during relative rotation of the two cap components, one of said fixed lugs of the inner cap component having a positive drive surface substantially normal to the end wall of the inner cap component and being engageable by the drive lug of the push button element when the latter is in a depressed driving position to cause release of the safety cap from a container, a spring ramp element rising from the end wall of the inner cap component and lying between a pair of said fixed lugs of the inner cap component and having a free end extending above the tops of said fixed lugs, and a driving element on the outer cap component separate from and spaced circumferentially from the depending drive lug of the push button element and being engageable with the free end of said spring ramp element during the screwing down of the safety cap on a container to drive the inner cap component to a fully tightened position.

12. A safety cap for threaded containers as defined in claim 11, and interfitting lockable recess means on the free end of the spring ramp element and on said driving element to assure positive driving of the inner cap component by the outer cap component during the screwing down of the safety cap.

13. A safety cap for threaded containers as defined in claim 11, and the spring ramp element being arcuate and elongated and following the periphery of the inner cap component and extending around a substantial circumferential portion of the inner cap component less than 180 degrees between one pair of said fixed lugs on the inner cap component.

14. A safety cap for threaded containers as defined in claim 11, and one pair of said fixed lugs on the inner cap component being spaced apart circumferentially approximately 180 degrees, one fixed lug of said pair having two convergent inclined ramp surfaces and the other lug of the pair having a single inclined ramp surface, and said other lug of the pair being positioned close to the free end of said spring ramp element.

* * * * *